United States Patent [19]

Baucom

[11] Patent Number: 4,971,207

[45] Date of Patent: Nov. 20, 1990

[54] FIREWOOD HOLDERS

[76] Inventor: Clarence L. Baucom, Rte. 1, Box 27, Porter, Okla. 73107

[21] Appl. No.: 123,250

[22] Filed: Nov. 20, 1987

[51] Int. Cl.[5] ..... A47F 7/00

[52] U.S. Cl. ..... 211/49.1; 211/60.1

[58] Field of Search ..... 211/49.1, 60.1, 181, 211/195, 175, 42, 43, 182, 198

[56] References Cited

U.S. PATENT DOCUMENTS

| | | | |
|---|---|---|---|
| 397,750 | 2/1889 | Phinney | 211/49.1 |
| 1,393,054 | 10/1921 | Turner | 211/60.1 |
| 2,061,937 | 11/1936 | Fay | 211/48.1 |
| 2,539,809 | 1/1951 | Buckley | 211/49.1 X |

*Primary Examiner*—Sarah A. Lechok

*Attorney, Agent, or Firm*—Head & Johnson

[57] ABSTRACT

A firewood holder is disclosed which is constructed of two support sections each including an elongated rung portion and two end portions extending perpendicular to the rung portions, a hinge connecting the respective free ends of the end portions, and a baseplate having a series of spaced apart grooves in its upper surface so that the rungs of the two support sections can be placed in different grooves of the baseplate to enable the firewood holder to be used to support different lengths of firewood.

5 Claims, 3 Drawing Sheets

FIREWOOD HOLDERS

SUMMARY OF THE INVENTION

My invention is a firewood holder, that is portable, lightweight, and of triangular shape, hinged at the top with baseplates that are grooved with corresponding grooves at varying spaces, and allows for the firewood holder to adjust easily to hold many different lengths of firewood. Because this firewood holder does all of the above, and is manufactured at low cost and because there are many homes in this country that have wood stoves and fireplaces that use different lengths of firewood, I believe there will be a great demand for my invention.

DESCRIPTION OF THE PREFERRED EMBODIMENT

Figure 1:
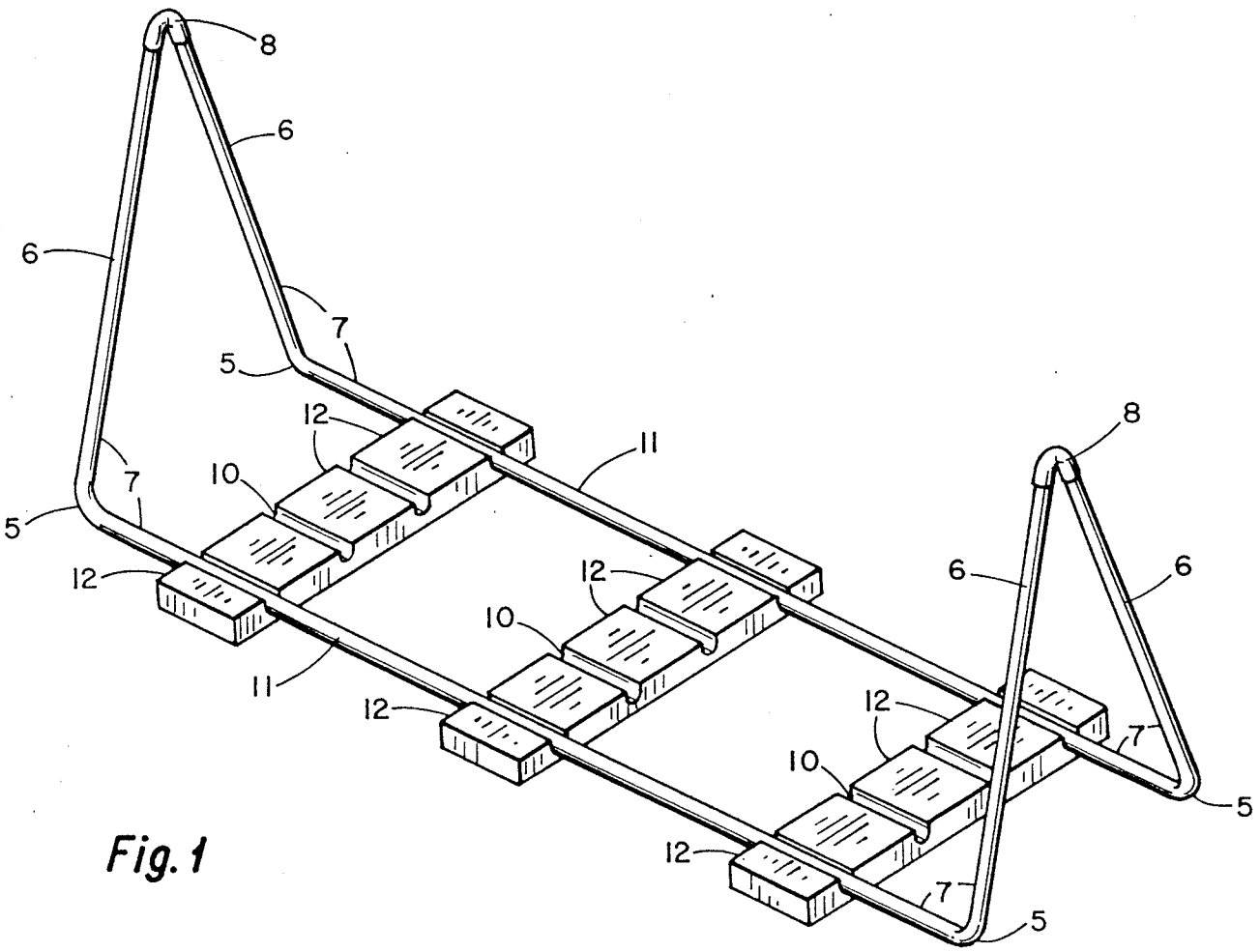
FIG. 1: An inventive firewood holder in position to hold wood.
Figure 2:
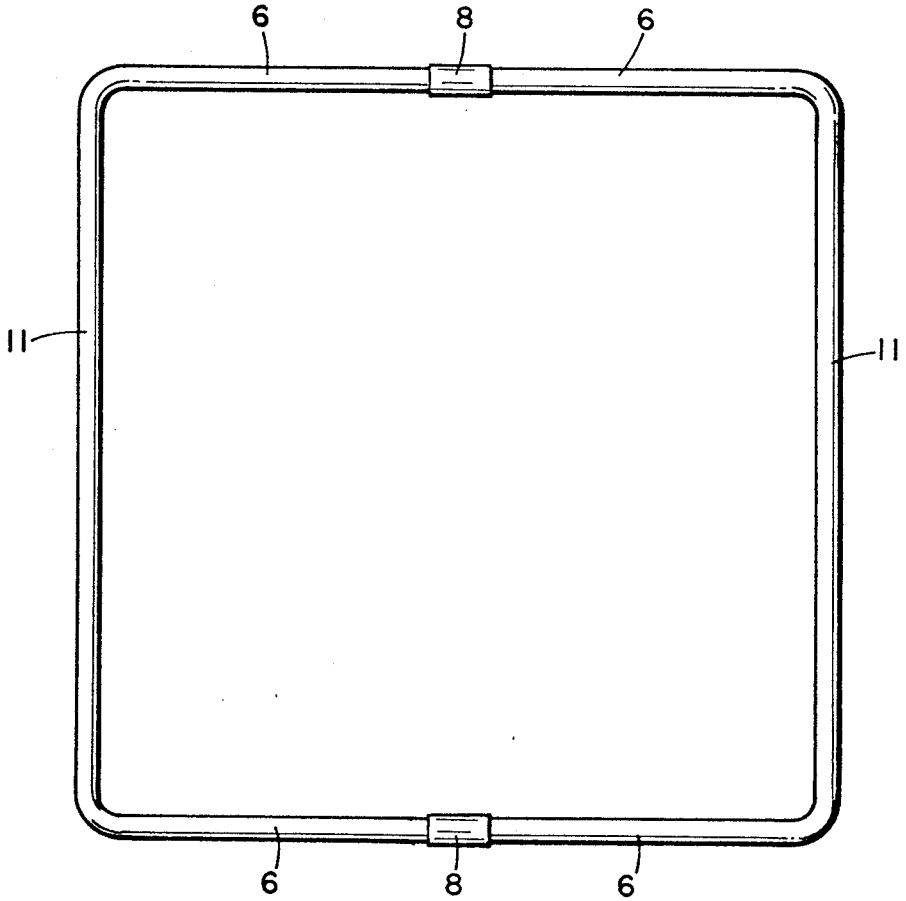
FIG. 2: Holder of FIG. 1 completely open.
Figure 7:
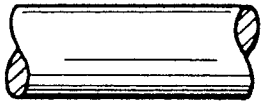
FIG. 7: Metal rod for manufacturing holder.
Figure 8:
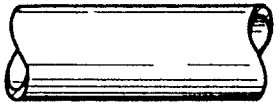
FIG. 8: Metal pipe for manufacturing holder.

To manufacture firewood holder shown in FIG. 1, I use two straight pieces of metal pipe as illustrated in FIG. 7 or two straight pieces of metal rod as illustrsated in FIG. 8. The two pipes or tubes employed are of the same length and are of length needed to manufacture firewood holders of the size desired. I then bend both ends of the pipe or rod as shown in FIG. 1. Bends are made such that the end portions 6 are of the same lengths as shown in FIG. 1. Both ends of each piece will bend to a 90 degree angle 7 as shown in FIG. 1.

Figure 4:
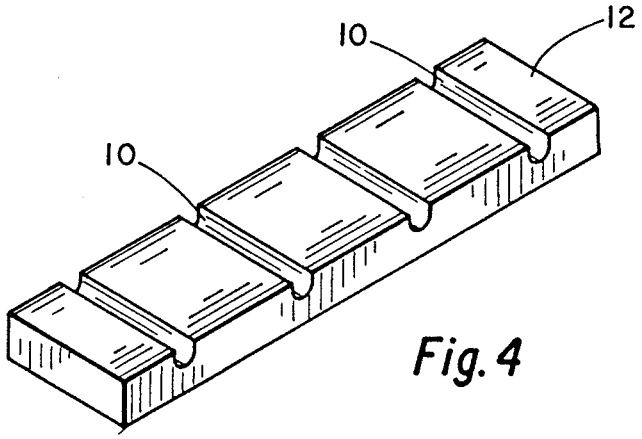
FIG. 4 Baseplate part of firewood holder.
Figure 5:
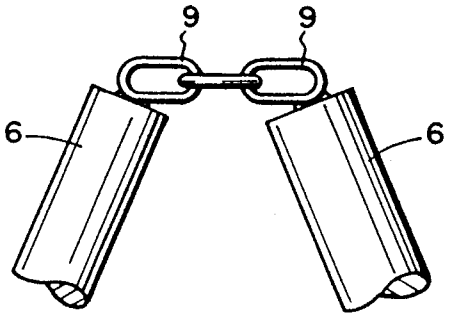
FIG. 5: Chain attached to ends, for use as hinge on inventive firewood holder.
Figure 6:
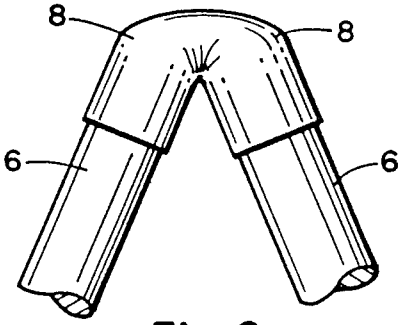
FIG. 6: Nylon reinforced plastic tubing attched to ends for use as a hinge on inventive firewood holder.
Figure 3:
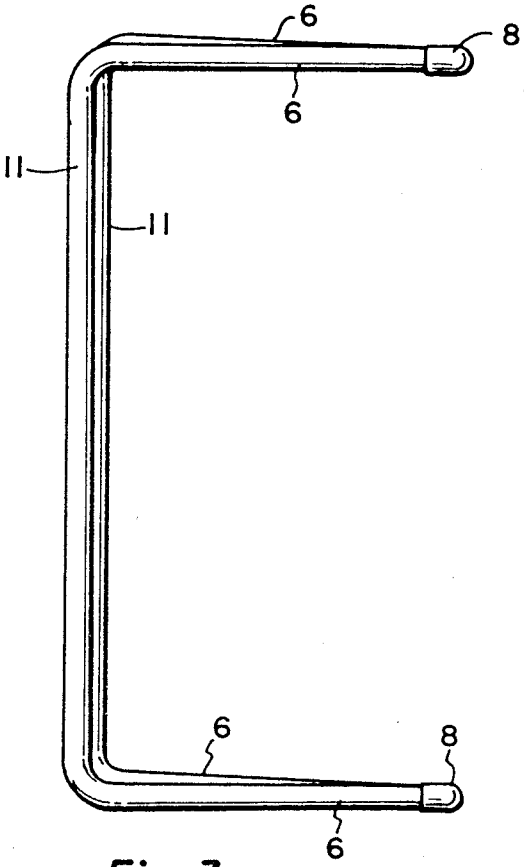
FIG. 3: Holder of FIG. 2 completely closed.

The 90 degree angle bends of both ends of each pipe or rod will be parallel to each other as shown in FIG. 1. The two pieces of bent material will then be attached at each end with a hinge made of nylon reinforced plastic tubing 8 as shown in FIGS. 1 and 6 or attached with a hinge made of chain 9 as shown in FIG. 5 or attached with any other useable hinge. To manufacture baseplate parts 12 of FIGS. 1 and 4, used rectangularly shaped wood or metal of varyinhg width, height, and length. I then cut corresponding grooves 10 as shown in FIGS. 1 and 4 that are of the same width and depth as the diameter of the metal rod or pipe that is used, as shown in FIG. 1. The grooves will be spaced at varying distances from each other as shown in FIGS. 1 and 4 to allow the rungs 11 to rest in different grooves as shown in FIG. 1, which will allow the firewood holder to adjust into various and corresponding grooves to make the firewood holder easily adjustable to hold many different lengths of firewood.

I claim:

1. A firewood holder comprising two support sections each including an elongated rung portion and two end portions extending perpendicular to said rung portion and being co-planar therewith, a hinge means connecting the respective free ends of the end portions of one of said suport sections to the free ends of the end portions of the other of said support sections so that the two support sections can pivot relative to each other, and at least one baseplaste comprising a plate having a series of spaced apart grooves in the top surface thereof, said grooves being dimensioned so as to be capable of receiving the rungs of the two suport sections so that the end portions of said support sections will extend upwardly above the respective rung portions in a position suitable for retaining a stack of wood.

2. A firewood holder according to claim 1 wherein each said support section in constructed of a single piece of pipe.

3. A firewood holder according to claim 1 wherein each said support section is contructed of a single rod.

4. A firewood holder according to claim 1 wherein said hinge means is a section of tubing which has been slipped over the respective free ends of the end portions of said support section.

5. A fireplace holder according to claim 1 wherein said hinge means is a length of chain securing the respective free ends of the end portions of said support sections.

* * * * *